United States Patent [19]

Brachert et al.

[11] 4,106,960

[45] Aug. 15, 1978

[54] TEMPERATURE-COMPENSATING PROPELLANT CHARGE

[75] Inventors: Heinrich Brachert; Johannes Eich, both of Troisdorf, Germany

[73] Assignee: Dynamit Nobel Aktiengesellschaft, Troisdorf, Germany

[21] Appl. No.: 763,161

[22] Filed: Jan. 27, 1977

[30] Foreign Application Priority Data

Feb. 3, 1976 [DE] Fed. Rep. of Germany ..... 2603927

[51] Int. Cl.[2] ..... C06B 45/22

[52] U.S. Cl. ..... 149/11; 149/10; 149/98; 149/100

[58] Field of Search ..... 149/11, 10, 98, 100

[56] References Cited

U.S. PATENT DOCUMENTS

| | | | |
|---|---|---|---|
| 2,858,289 | 10/1958 | Bohn et al. | 149/10 X |
| 3,409,658 | 11/1968 | Emmons | 149/10 X |
| 3,682,726 | 8/1972 | Stiefel | 149/10 |
| 3,704,185 | 11/1972 | Cooner | 149/10 X |
| 3,897,733 | 8/1975 | Stiefel et al. | 149/10 X |

*Primary Examiner*—Stephen J. Lechert, Jr.

*Attorney, Agent, or Firm*—Burgess, Dinklage & Sprung

[57] ABSTRACT

A propellant charge composition comprising individual powder particles of a nitrocellulose propellant coated with a coating of an acrylic resin and a process for its preparation. Also disclosed is a propellant charge composition of the type described containing a second propellant.

16 Claims, No Drawings

TEMPERATURE-COMPENSATING PROPELLANT CHARGE

BACKGROUND OF THE INVENTION

1. Field of the Invention

This invention relates to propellant charge compositions containing as the propellant a nitrocellulose propellant. More particularly, this invention relates to propellant charge compositions whose activity is independent of temperature. This invention further relates to such propellant charge compositions combined with other propellant charge compositions.

2. Discussion of the Prior Art

Nitrocellulose-containing propellant charges have long been known. In the unmodified state they are known as "green powder". Generally, they burn in a ballistic bomb test producing a sharp pressure peak which is followed by a sharp and rapid drop of the pressure. The sharp pressure peak results in a failure to convert the total energy into kinetic energy as desired, some of the energy being lost in the form of static energy. The leveling of the pressure peak and the spreading out of the maximum pressure over a longer period, therefore, produces an improvement of the efficiency of the powder. A number of methods have been proposed for the modification of the propellant charge powder in order to level this undesirably sharp pressure peak and to provide a longer sustenance of the pressure.

Thus it is known to mix plasticizers or phlegmatizers with the propellant charge powders in order to flatten the pressure peak. Such substances are, for example, camphor, urea derivatives known as centralites, or esters of dibasic organic dicarboxylic acids, such as, for example, the ethyl, hexyl or octyl esters of the phthalic acids. These substances are deposited in the surface of the powder with the aid of solvents which swell the surface of the powder (cf. German "Offenlegungsschrift" No. 2,351,778, for example). They are thus within the uppermost stratum of the powder grains in a more or less thick layer. By this procedure it is possible to diminish the pressure peak and achieve a better pressure characteristic than in the case of green powder. The results achieved, however, are not satisfactory, since not only is the drop in pressure, as measured in the ballistic bomb, still too fast, but also the pressure characteristic is temperature-related.

The temperature-dependence of the powder reveals itself in the ballistic bomb in the fact that, in the burning both at low temperatures (−50° C) and at room temperature, or at +50° C, the dynamic liveliness (pressure change per unit of time, with respect to the sum of the pressure at the moment and the maximum pressure) is directly proportional to the temperature, i.e., the higher the temperature the greater is the liveliness measured in the ballistic bomb.

It is an object of this invention, therefore, to provide a propellant charge composition which during burning in a ballistic bomb test shows a dynamic liveliness which is independent of temperature. It is a further object of this invention, therefore, to provide a propellant charge powder which in burning produces virtually no sharp pressure peak and in which the gas pressure which develops is sustained over an extended period of time.

SUMMARY OF THE INVENTION

In accordance with this invention, a propellant charge composition is provided which propellant charge composition comprises individual powder particles of a nitrocellulose propellant coated with a coating of an acrylic resin. This invention further contemplates a propellant charge composition comprising the aforedescribed propellant charge in combination with at least one additional propellant.

In accordance with this invention, it has been found that nitrocellulose propellants which are coated with an acrylic resin are temperature independent when tested in a ballistic bomb test for their burning properties. It has further been observed that the propellant charge of the present invention when combined with a second propellant provides an overall composition which is temperature independent. The propellant charge composition of the invention has a retarded ignition and functions ideally with other propellant charge compositions, especially those having a rapid ignition.

It is known to provide propellant charge powders with an enveloping coating. Thus, ball powders have formerly been enveloped in gelatin for the purpose of influencing the maximum pressure and the burning characteristics of this powder. Nevertheless, this has not permitted control of the temperature characteristics of the powder.

The propellant charge powder of the invention not only has burning characteristics which are independent of temperature, but also it has a retarded ignition, which proves to be especially desirable for its use in combined powder charges. The temperature independence is demonstrated by the fact that the dynamic liveliness, measured in the ballistic bomb, is inversely proportional to the temperature. Chilled powders of the invention react in a more lively manner than heated powders.

When the powder of the invention is used with, for example, a known commercial powder in a combined charge, such as a duplex charge, for example, several interesting effects are observed. At low temperatures, the known powder brings about a low liveliness and the powder enveloped in accordance with the invention produces a higher liveliness. At elevated temperature, the known powder has a high liveliness, while the powder of the invention has a reduced liveliness. The combined gas development, therefore, is approximately the same in all temperature ranges so that the combined charge is largely independent of temperature. Such can be seen from a consideration of the graphic illustration appended hereto and discussed further below.

Depending on the percentages of the individual charge components and the modification of the "green powder" which may have been performed by formerly known methods, one can produce a combined powder which can be used for a specific purpose. The powder of the invention can accordingly be admixed in any desired percentage with known and modified or unmodified powders. Generally speaking, the powder of the invention is combined with a known powder in an amount between 10 and 90 percent, preferably 30 and 70 percent, based upon the weight of the combined powders.

The coating of the nitrocellulose propellant powder is performed by dissolving or dispersing the acrylic resin in a solvent. The solvent employed should be one which is a non-solvent of the nitrocellulose propellant, i.e., the nitrocellulose should be poorly soluble or insoluble in the solvent. The solution or dispersion of acrylic resin is applied to the nitrocellulose powder by immersion, spraying, brushing, or wiping. Aromatic solvents can be employed including especially benzene and toluene. The coating does not have to be applied all at once in a single layer. One can desirably apply the coating composition (varnish) to the nitrocellulose particles in a plurality of thinned layers and, prior to the application of a subsequent layer, remove the solvent by purging the treating vessel containing the propellant particle so coated with compressed air while continuing to rotate the vessel.

The usable acrylic resins include polymers and copolymers of acrylic acid and methacrylic acid, and the esters, nitriles or amides of these acids. The esters are mainly the methyl, ethyl and butyl esters. Mixtures of these resins with one another or with other resines can also be used, provided that the percentage of the acrylic resins in these resin mixtures amounts to at least 50% by weight. Generally speaking, the acrylic resins employed will have a molecular weight between 100,000 and 200,000, preferably between 120,000 and 150,000, the molecular weight being determined in accordance with the following procedure:

The particle size of the treated nitrocellulose propellant is generally 1,000 to 10,000 $\mu$m, preferably 3,000 to 6,000 $\mu$m. The resultant composition, i.e., the coated composition has a particle size in the range of 1,000 to 10,000 $\mu$m, preferably 3,000 to 6,000 $\mu$m. Generally speaking, the coating will have a thickness of between $5 \times 10^4$ and $3 \times 10^6$, preferably $1 \times 10^6$ and $2 \times 10^6$ angstroms.

Fillers and flameproofing agents can also be included with the resins in known manner. Generally speaking, when a filler is present in the composition, it is present in an amount between 15 and 40 percent, preferably between 25 and 30 percent. When a flameproofing agent is included, it is present in the composition in an amount between 5 and 20 percent, preferably 10 and 15 percent.

The thickness of the resin coating on the powder particles can vary widely; it deponds on, among other things, the diameter and the shape of the particles and on the desired characteristics of the powder. The total coating, however, is to amount to approximately 2 to 25 weight percent with respect to the weight of the powder. The preferred range is between 10 and 20 weight percent with respect to the weight of the powder.

Either monobasic and polybasic powders can be used as propellant charge powders. The polybasic powders can contain glycerin trinitrate and/or glycol dinitrate and/or nitroguanidine and/or hexogen, in addition to nitrocellulose. The glycerin trinitrate can also be replaced partially or entirely by other explosive organic nitric acid esters, such as, for example, diglycol dinitrate, triglycol dinitrate, methriol trinitrate or butanetriol trinitrate.

The powders can also be of any desired geometrical shape. Accordingly, the powder can be in the form, for example, of a single-perforated or multiperforated powder, or in the form of ball powder, flake powder, tubular powder or strip powder.

In order to more fully illustrate the nature of the invention and the manner of practicing the same, the following example is presented:

EXAMPLE

In a flask, 150 g of a polymethyl methacrylate (commercial name M 345 of Röhm GmbH, Darmstadt) is dissolved in 800 g of toluene at 60° C with stirring. Into this solution, 27 g of titanium dioxide plus 15 g of diphenylcresyl phosphate and 0.5 g of $Sb_2O_3$ are placed. After brief stirring, the mixture is transferred to a ball mill where it is ground for 20 hours for the uniform distribution of the fillers.

Half of the obtained mixture is thinned with toluene to a viscosity of 11 seconds of pouring time from a Ford beaker using a No. 4 nozzle. This varnish solution is sprayed with a spray gun onto 400 grams of a tribasic powder. The powder was in the form of 19-perforation granules with a diameter of about 5.4 mm and a length of 6.0 mm. It was contained in a "sweetie barrel," or dry coating drum which had been set up at such an angle of inclination that the powder particles poured downwardly.

While the "sweetie barrel" was turning, the grains were sprayed for about 3 minutes at a time and then treated with compressed air for about 15 minutes to drive off the solvent. This procedure is repeated about 20 times. Then the coated powder is dried for another 17 hours at 25° C in a recirculated-air drying oven with fresh air input.

This powder is placed together with a monobasic 19-perforation green powder in a ratio of 20 : 80 in a ballistic bomb. This bomb is given a temperature of −50° C, +20° C, and +50° C, respectively, before the powder is ignited electrically. Measurement is made of the dynamic liveliness in relation to the proportion of the powder mass burned. The results of the measurement are shown in the appended graphic representation.

From this graph it can easily be seen that at first the charge composed of the known propellant powder burns, this burning having the formerly known, normal burning and temperature behavior. Not until a point situated after the very evident fall-off of the pressure curves of this first charge does the powder of the invention burn in a retarded manner, with an inverted temperature behavior.

What is claimed is:

1. A propellant composition comprising individual powder particles of a nitrocellulose containing propellant coated with a material consisting essentially of an acrylic resin having a molecular weight between 100,000 and 200,000, the coating comprising 10 to 20% by weight of the propellant.

2. A propellant charge composition according to claim 1 wherein the coating comprises 2 to 25 percent by weight of the propellant.

3. A propellant charge composition according to claim 1 wherein the acrylic resin is polymethyl methacrylate.

4. A propellant charge composition comprising the propellant charge composition of claim 1 and a second propellant.

5. A propellant charge composition according to claim 1 which is temperature-independent.

6. A process for preparing the composition of claim 1 which comprises applying to individual powder particles of a nitrocellulose propellant an acrylic resin dissolved or dispersed in a solvent and thereafter removing solvent therefrom.

7. A process according to claim 6 wherein the solvent is removed by applying compressed air thereto.

8. A propellant charge composition according to claim 1 wherein said propellant composition contains a monobasic or polybasic powder.

9. A propellant charge composition according to claim 8 wherein said propellant composition contains a polybasic powder.

10. A propellant charge composition according to claim 1 wherein said propellant composition contains glycerin trinitrate and/or glycol dinitrate and/or nitroguanidine and/or hexogen and/or an explosive organic nitric acid ester.

11. A propellant charge composition consisting essentially of individual powder particles of a nitrocellulose propellant coated with a coating, said coating consisting essentially of an acrylic resin having the molecular weight between 100,000 and 200,000, said coating comprising 10 to 20% by weight of the propellant.

12. A propellant charge composition according to claim 11, wherein the acrylic resin has a molecular weight between 120,000 to 150,000.

13. A propellant charge composition according to claim 12, wherein the coating has a thickness between $5 \times 10^4$ and $3 \times 10^6$ angstroms.

14. A composition according to claim 13, containing a filler in an amount between 15 and 40 percent.

15. A composition according to claim 13, containing a flameproofing agent in an amount between 5 and 20 percent.

16. A composition according to claim 13, wherein said acrylic resin is a polymethyl methacrylate.

* * * * *